United States Patent [19]

LaBate

[11] Patent Number: 4,991,752

[45] Date of Patent: Feb. 12, 1991

[54] METHOD AND APPARATUS FOR STIRRING AND POURING MOLTEN METAL IN A NEUTRAL ATMOSPHERE

[76] Inventor: Micheal D. LaBate, 115 Hazel Ave., Ellwood City, Pa. 16117

[21] Appl. No.: 468,109

[22] Filed: Jan. 22, 1990

[51] Int. Cl.[5] ..... B22D 37/00

[52] U.S. Cl. ..... 222/590; 222/603; 222/606

[58] Field of Search ..... 222/603, 606, 607, 590; 266/45

[56] References Cited

U.S. PATENT DOCUMENTS

| | | | |
|---|---|---|---|
| 3,460,725 | 8/1969 | Golde et al. | 222/603 |
| 4,429,816 | 2/1984 | Thrower | 222/603 |
| 4,555,050 | 11/1985 | Schiefer | 222/597 |
| 4,619,443 | 10/1986 | Mitchell | 266/220 |
| 4,624,292 | 11/1986 | LaBate | 141/5 |
| 4,740,241 | 4/1988 | LaBate | 266/225 |
| 4,756,452 | 7/1988 | Tsukamoto et al. | 272/603 |
| 4,854,487 | 8/1989 | Ando et al. | 222/606 |

FOREIGN PATENT DOCUMENTS

| | | | |
|---|---|---|---|
| 0146458 | 9/1982 | Japan | 222/603 |

*Primary Examiner*—S. Kastler

*Attorney, Agent, or Firm*—Harpman & Harpman

[57] ABSTRACT

A method and apparatus for stirring molten metal as it is poured into a covered metallurgical vessel in a neutral atmosphere. A gas pressurized tube shroud assembly is positioned in an opening in the covered metal vessel and wherein atmosphere is replaced by the injection of inert gas under pressure through the shroud assembly. Molten metal is poured through a portion of the shroud assembly and as it becomes partially submerged within the molten metal forms a bubble field around the shroud protecting it from nonmetallic inclusions and associated erosion normally incurred.

4 Claims, 1 Drawing Sheet

METHOD AND APPARATUS FOR STIRRING AND POURING MOLTEN METAL IN A NEUTRAL ATMOSPHERE

BACKGROUND OF THE INVENTION

1. Technical Field:

This invention relates to a method and apparatus for pouring and stirring molten metal into a receiving vessel in a neutral atmosphere.

2. Description of Prior Art:

Prior Art devices of this type have generally been directed to shroud systems and stirring lances that inert gas or oxygen to the molten metal to form either shroud seals as seen in U.S. Pats. No. 4,429,816, U.S. Pat. No. 3,460,725, U.S. Pat. No. 455,050 and applicant's U.S. Pat. No. 4,624,292 or stirring lances see for example U.S. Pats. No. 4,619,443 or applicant's U.S. Pat. No. 4,740,241.

In U.S. Pat. No. 4,429,816 a union for providing inert gas is disclosed that utilizes a union block between a pouring nozzle and a pouring tube. The union block has a metal jacket surrounding same for the inclusion of inert gas under pressure to form a seal and a protective gas film within the pouring tube.

U.S. Pat. No. 3,460,725 discloses a two-part refractory shroud tube into which inert gas can be added under pressure.

U.S. Pat. No. 4,555,050 shows a closure mechanism with a gas seal for discharged nozzles on a metallurgical vessel. A snug conical joint is formed between the discharge nozzle and a shielded tube. An annular surface is formed defining a ring shaped seal that is filled with inert gas.

In applicant's U.S. Pat. No. 4,624,292 a method and apparatus is disclosed that uses a closure within the vessel through which a pouring nozzle extends. Inert gas is supplied through the closure in spaced relation to the nozzle engagement forming a neutral inert gas atmosphere within the vessel and around the nozzle.

U.S. Pat. No. 4,740,241 and applicant's U.S. Pat. No. 4,619,443 shows examples of stirring lance configurations that can be used in metallurgical vessels. Each has a cast or coalesce refractory body through which gas tubes extend and exit therefrom.

SUMMARY OF THE INVENTION

A method and apparatus for pouring and stirring molten metal in a neutral atmosphere wherein a multiple tube gas injection apparatus extending from a pouring source is positioned within a receiving vessel and thereby defines an inner passageway for the molten metal that is permeated with inert gas as it passes through and exits therefrom.

DESCRIPTION OF THE PREFERRED EMBODIMENT

Figure 1:
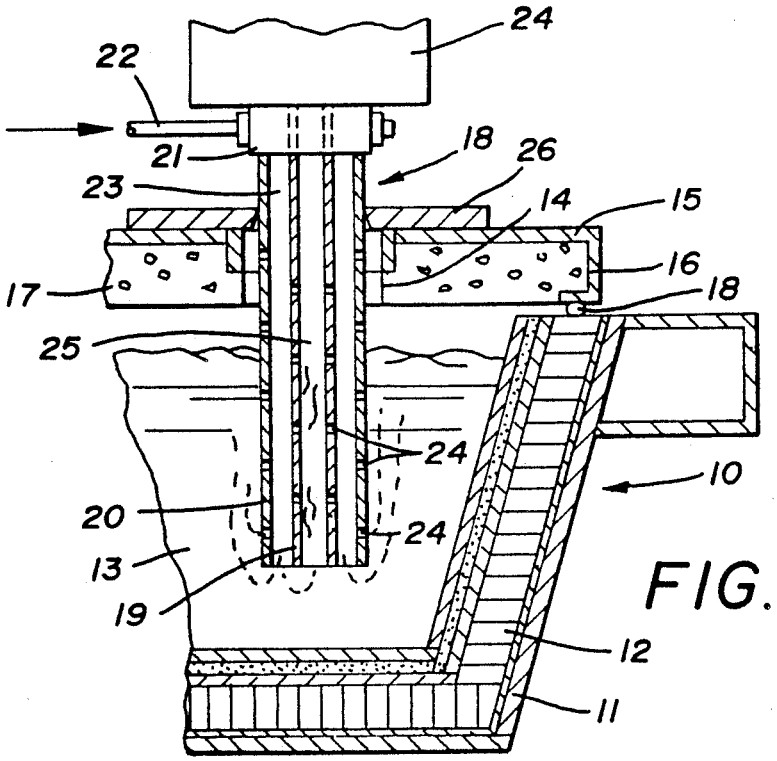
FIG. 1 is a partial cross-section view through a portion of an insulated lined tundish having the invention positioned during use.

Referring to FIG. 1 of the drawings a portion of a receiving vessel such as a tundish 10 can be seen comprised of a metal shell 11 and an insulating layer 12 therein. The tundish 10 is an intermediary receiving vessel from which molten metal 13 is poured to a continuous caster or ingot molds as is well known in the art.

The molten metal 13 is introduced into the tundish 10 through an opening 14 located in a tundish cover 15 which is positioned on the tundish 10 in spaced relation to the molten metal 13. The tundish cover 15 is comprised of multiple sectioned elements each of which has a metallic casing 16 filled with a cast, rammed or coalesced refractory insulation material 17 or the like. A clay rope seal 18 is provided as a sealing gasket between the tundish covers 15 and the tundish 10.

The molten metal 13 passes into the tundish 10 through a gas pressurizing tube assembly 18 comprised of a pair of tubular elements 19 and 20 of a heat resistant material placed within one another that defines a submerged shroud.

Figure 2:
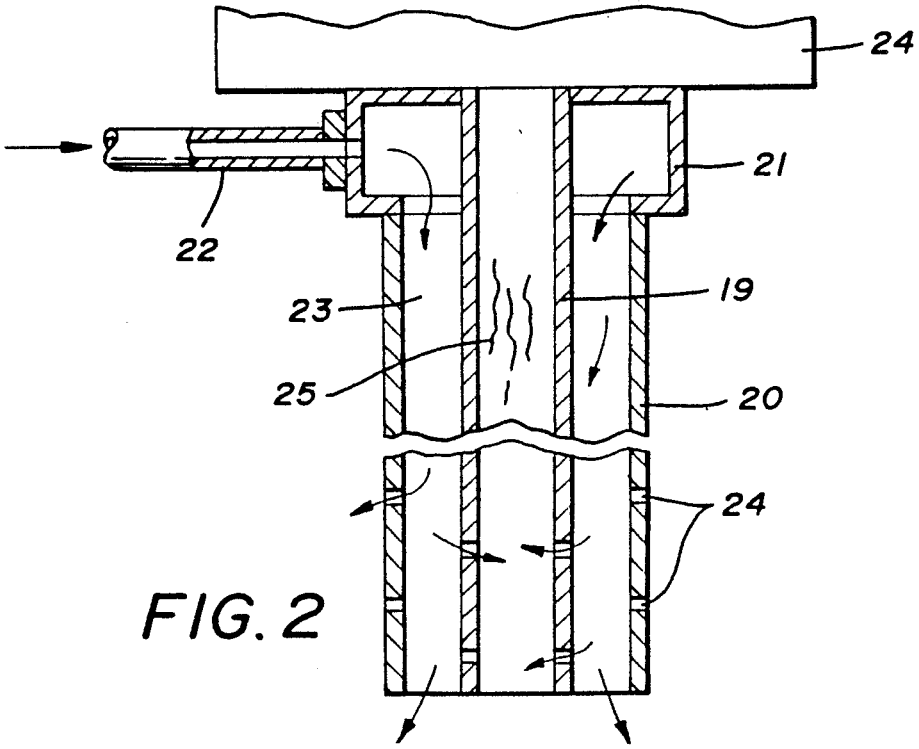
FIG. 2 is an enlarged partial cross-section of the gas inlet and circulation portion of the invention.

Referring now to FIGS. 1 and 2 of the drawings a gas distribution and spacing ring 21 can be seen secured to the upper ends of said tubular elements 19 and 20. A gas supply line 22 extends into said distribution and spacing ring 21 and communicates with the space between the respective tubes at 23.

A ladle slide gate 24 or other valve means connects with the inner tubular element 19 providing a direct stream for the molten metal 13 transferring same from the source of molten metal to the tundish 10.

As the molten metal 13 is received within the tundish 10 through the inner tubular element 19 inert gas such as argon under pressure is supplied by the gas supply line 22 to the gas distribution and spacing ring 21 and the interconnected outer tubular element 20 surrounding the inner tubular element 19 with inert gas. A plurality of spaced apertures 24 are formed in both tubular elements 19 and 20 for expelling inert gas therefrom creating a gas coating on the outer surfaces of the respective tubular elements 19 and 20 and impinging into a molten metal stream 25 within the inner tubular element 19 during pouring.

The neutral atmosphere created around the tubular element 19 within the gas pressurizing tube assembly assures that insoluble nonmetallics intrained in the molten metal stream 25 will not adhere to and increase the erosion of the tubular elements 19 and 20 to a great extend thus increasing their respective useful life.

It will be understood by those skilled in the art that the tubular elements 19 and 20 are formed of materials that are readily resistant to the temperatures of molten metal present when combined with the high volume flow of inert gas around and through them, such materials include refractories.

A refractory shroud sealing ring 26 made of refractory fibrous material is placed around the gas pressurization tube assembly 18 on top of the tundish cover 15 to form a closed neutral environmental atmosphere within the tundish 10 due to the high volume of inert gas being supplied to the tundish via the gas pressurization tube assembly as hereinbefore described.

The infusion of inert gas around the point of molten metal introduction into the tundish will produce a stirring effect that will help maintain insoluble nonmetallics in suspended motion moving to the surface of the molten metal 13 as the tundish is filled. The floating insoluble nonmetallics then can be drawn off the surface of the molten metal 13 by conventional means thus improving the quality of the steel within the tundish.

It will thus be seen that a method and apparatus for stirring and pouring molten metal in a neutral atmosphere into a metallurgical vessel such as a tundish has been disclosed that provides for a protective gas barrier and stirring enhancement within the tundish.

It will be apparent to those skilled in the art that various changes and modifications may be made therein without departing from the spirit of the invention, therefore I claim:

1. A gas pressurizing shroud assembly extending from a source of molten metal to a receiving vessel, comprises first and second coaxial tubular elements of a known length within one another, said first tubular element being of a diameter less than said second tubular element, said first tubular element being in communication with said source of molten metal, a distribution and spacing ring is secured to one end of said tubular elements defining an enclosure communicating with said second tubular element, means for supplying inert gas under pressure to said distribution and spacing ring, said first and second tubular elements having a plurality of longitudinally spaced apertures therein, said spaced apertures in said first tubular element supplying said inert gas to said source of molten metal within the length of said first tubular element, means for sealing said receiving vessel from atmosphere and means for sealing said gas pressurized shroud assembly to said means for sealing said receiving vessel.

2. The gas pressurizing shroud assembly of claim 1 wherein said tubular elements are of a heat resistant material.

3. The gas pressurizing shroud of claim 1 wherein said means for sealing said shroud to said means for sealing said receiving vessel comprises a refractory shroud sealing ring around said gas pressurizing shroud.

4. A method of pouring molten steel into a tundish in a neutral atmosphere comprises the steps of sequentially, closing said tundish with a closure, positioning a gas pressurizing shroud assembly through an opening in said closure, said gas pressurizing shroud having a first and second tubular elements, sealing said shroud to said closure, injecting inert gas under pressure into said tundish through said first and second tubular elements, pouring molten metal through said first tubular element, impinging said molten metal within said first tubular element with inert gas, creating a gas layer between said second tubular member and said molten metal within said tundish, filling said tundish with molten metal to a level in spaced relation to said closure, removing insoluble nonmetallics from said molten metal by infusion of inert gas under pressure through said first and second tubular elements.

* * * * *